US005941347A

United States Patent [19]

Pfleger et al.

[11] Patent Number: 5,941,347

[45] Date of Patent: Aug. 24, 1999

[54] PORTABLE LIFT

[75] Inventors: Robert H. Pfleger, Milwaukee; Gene M. Barth, West Bend, both of Wis.

[73] Assignee: Pflow Industries Inc., Milwaukee, Wis.

[21] Appl. No.: 08/863,163

[22] Filed: May 27, 1997

[51] Int. Cl.[6] ..... B66F 9/22

[52] U.S. Cl. ..... 187/234; 187/244

[58] Field of Search ..... 187/244, 240, 187/243, 239, 231, 232, 234, 222, 272; 182/141

[56] References Cited

U.S. PATENT DOCUMENTS

| | | | |
|---|---|---|---|
| 1,689,259 | 10/1928 | Shepard, Jr. et al. | 187/231 |
| 3,054,519 | 9/1962 | Fleming | 187/244 |
| 3,489,249 | 1/1970 | Stammen | 187/234 |
| 4,683,988 | 8/1987 | Shrum, Jr. | 187/234 |
| 4,987,992 | 1/1991 | Pfleger | 198/475.1 |
| 5,205,379 | 4/1993 | Pfleger | 187/26 |

*Primary Examiner*—Kenneth Noland
*Attorney, Agent, or Firm*—Andrus Sceales Starke & Sawall

[57] ABSTRACT

A portable lift for transporting cargo between different vertical levels of a building. The lift comprises a frame mounted for movement on a plurality of wheels. A carriage having a cantilevered platform that is adapted to support the cargo is mounted for vertical movement on the frame between a lower level and an upper level. The wheels can be manually moved between a lower supporting position where they support the frame for movement to an upper, non-supporting position. Movement of the wheels to the upper, non-supporting position automatically engages a locking mechanism to lock the frame to the building to prevent accidental movement of the frame during a loading operation. The platform of the carriage can be selectively positioned at either a lower position to receive cargo from mechanical handling equipment, or at an upper position to receive a manually carried cargo.

20 Claims, 3 Drawing Sheets

PORTABLE LIFT

BACKGROUND OF THE INVENTION

Mezzanines are used in factories, warehouses, retail and commercial establishments and provide floor space for storage and manufacturing operations. The mezzanine floor is typically between nine and eleven feet above the main building floor. Efficient usage of mezzanine space is dependent upon being able to move cargo up to and down from the mezzanine.

There are three main methods used to transport cargo to a mezzanine. Assuming the cargo is light enough, it can be hand carried. This is inefficient and can be hazardous with cumbersome and heavy loads.

Fork trucks are often used to elevate cargo to mezzanines. Fork trucks are expensive, and placing loads well above the operator's head can be dangerous.

The third commonly used method to deliver cargo to a mezzanine is through the use of a vertical reciprocating conveyor. These devices will handle large, heavy loads at required speeds. While less expensive than fork trucks, vertical conveyors are often too expensive for occasional light-duty usage.

SUMMARY OF THE INVENTION

The invention is directed to a lightweight, inexpensive vertical lift that is portable and is adapted to transport lighter loads between a lower level and an upper level in a warehouse or other commercial establishment, such as a mezzanine.

In accordance with the invention, the portable lift includes a frame which is mounted on a plurality of wheels or casters so that the frame is movable on the floor of the building. A carriage having a cantilevered platform that is adapted to support the load or cargo, is mounted for vertical movement on the frame. To move the carriage between the lower and upper levels on the frame, a hydraulic cylinder unit, including a pair of hydraulic cylinders, interconnects the frame and carriage. When the carriage is at the lower level, the piston rods of both of the cylinder units are in an extended position. By supplying hydraulic fluid to the cylinders, the piston rods are retracted to move the carriage from the lower level to the upper level.

As a feature of the invention, the wheels that support the frame can be moved between a lower supporting position, where the wheels act to support the frame and carriage for movement over the floor or terrain, and an upper position where the wheels are in a non-supporting position. When the wheels are moved to the upper, non-supporting position, a locking member on the conveyor frame will automatically engage a second locking member on the building adjacent the upper level to lock the frame in position and prevent accidental movement of the frame during a loading operation.

As a further feature of the invention, a safety mechanism is incorporated that includes a switch which is connected in an electrical circuit with the hydraulic drive mechanism, and the switch is adapted to close when the locking mechanism is engaged. With this construction, if the locking mechanism is not engaged, the hydraulic drive cannot be operated to move the carriage on the frame.

As a further aspect of the invention, the cantilevered cargo supporting platform can be connected to the carriage at two different vertical levels, one of which is located at the lower end of the carriage, and the second is located several feet above the lower position. When the platform is connected at its lower position adjacent the bottom of the lift, it is in position to receive cargo from mechanical handling equipment such as a hand truck. On the other hand, if the cargo is lightweight, the platform can be positioned at the higher level which aids in the manual placement and removal of cargo from the platform.

The lift of the invention is lighter weight and less expensive than vertical conveyors, and being portable can be moved to various locations as desired in the factory or warehouse.

The lift includes an automatic locking mechanism which will lock the lift to the building when the wheels are in the upper, non-supporting position to thereby prevent accidental movement of the lift during a loading operation.

The invention also provides a choice of platform heights for both mechanized and manual loading operations.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
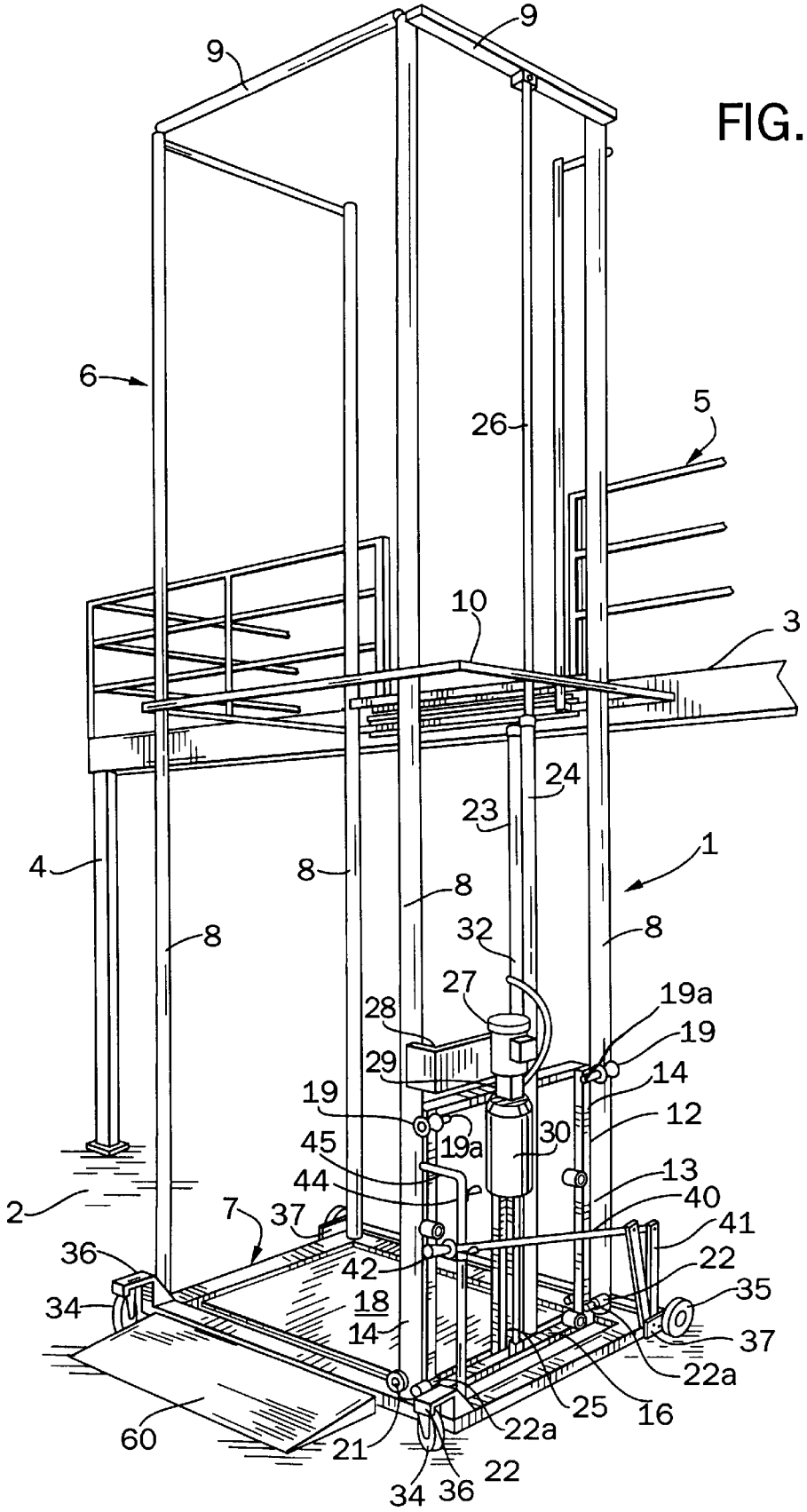
FIG. 1 is a perspective view of the lift of the invention with the carriage shown at the lower level.

FIG. 1 illustrates a portable lift 1 which is adapted to transport a cargo or load from a lower level or floor 2 of a building to an upper level 3 such as a mezzanine. The mezzanine 3 of the building, which can be factory, warehouse, or other commercial establishment, is supported by a series of vertical beams 4 and is bordered by a railing 5.

Lift 1 consists of a frame 6 composed of a generally rectangular base 7 and a plurality of vertical columns 8, preferably are cylindrical in configuration, which extend upwardly from the base. The upper ends of columns 8 are connected together by a series of upper cross members 9. In addition, an intermediate rectangular frame member 10 connects the central portions of the columns 8 together.

In practice, a wire mesh enclosure may be connected between columns 8 at the level of mezzanine 3, but for purposes of clarity, the enclosure is not shown in the drawings.

A carriage 12 is mounted for vertical movement on frame 6. Carriage 12 includes a generally rectangular section or frame 13 composed of a pair of vertical side members 14, an upper member 15 and a lower member 16 that connect the respective ends of side members 14. In addition, section 13 includes a central vertical member 17 which connects the upper and lower members 15 and 16 and is parallel to side members 14.

To support the load or cargo, a generally flat platform 18 is cantilevered outwardly from the carriage frame 13 and platform 18 has a size to generally fit within the base 7 of main frame 6. To guide carriage 12 for movement on frame 6, a pair of dog-bone shaped rollers 19 are journaled on shafts 19*a* that are secured to the upper ends of side members 14 of carriage frame 13, and as shown in FIG. 1, rollers 19 are positioned to ride on a pair of vertical columns 8 of frame 6. In addition, a pair of rollers 20 are journaled on shafts 20*a* which are also secured to the upper ends of side members 14 and are adapted to ride against opposite sides of the columns 8.

Further guiding is achieved by a pair of dog-bone shaped rollers 21 and rollers 22 that are journaled on shafts 21*a* and 22*a*, respectively secured to the lower ends of side members 14. As shown in FIG. 1, rollers 21 and 22 engage opposite sides of columns 8.

To move carriage 12 between the lower level 2 and the upper level or mezzanine 3, a pair of side-by-side hydraulic cylinder units 23 and 24 are connected between the carriage 12 and frame 6. As best shown in FIG. 1, the piston rod 25 of cylinder 23 is pivotally connected to the lower member 16 of carriage frame 13, while the piston rod 26 of cylinder 24 is secured to the upper cross member 9 of frame 6.

When carriage 12 is at the lower level 3, the piston rods 25 and 26 are both in an extended condition. By introducing hydraulic fluid to the cylinders 23 and 24, the piston rods 25 and 26 will be retracted, thus moving the carriage to the upper level 3.

The hydraulic system includes a pump 27 that is connected through a generally L-shaped bracket 28 to one of the vertical columns 8 of frame 6, as best shown in FIG. 1. A valve mechanism 29 and fluid reservoir 30 are suspended from pump 27. Pressurized hydraulic fluid is discharged from pump 27 through line 32 to the cylinders 23 and 24 and fluid is returned from the cylinders to the reservoir through the line 32.

As a feature of the invention, frame 6 can be supported for movement on the floor of the building by a plurality of wheels 34 and 35. Caster wheels 34 are mounted for universal movement on brackets 36 that are connected to base 7 of frame 6.

Wheels 35 are adapted to be moved vertically relative to base 7 of frame 6. In this regard, each wheel 35. is journaled on the end of a lever 37. The central portion of each lever 37 is mounted on a pivot shaft 38 which extends the length of base 7. Pivot shaft 38 extends through one of the hollow members of base 7 and interconnects the levers 37 at each side of frame 6.

Figure 3:
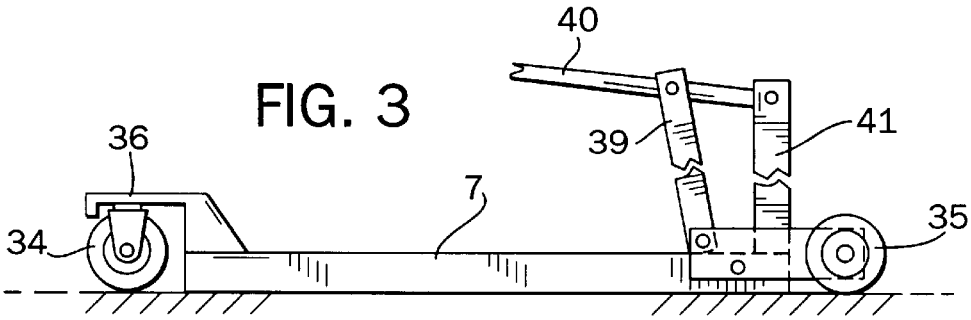
FIG. 3 is a view similar to FIG. 2 and showing the wheels in the upper non-supporting position.
Figure 2:
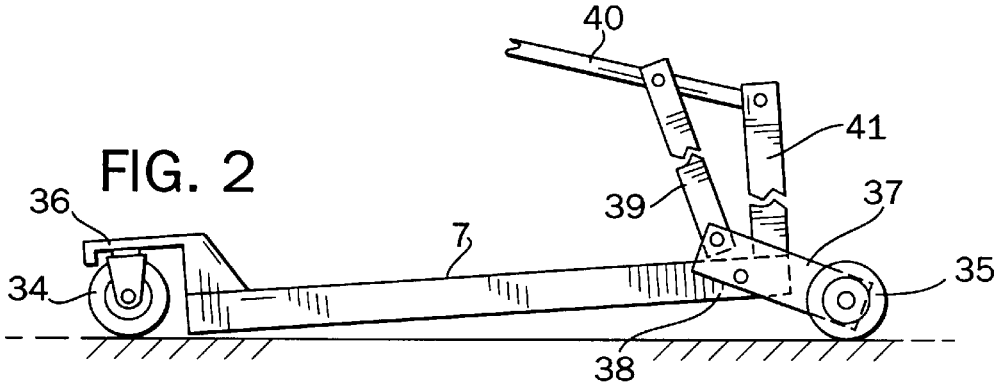
FIG. 2 is a fragmentary side elevation of the lower end of the frame showing the wheels in the lower supporting position.

As best shown in FIGS. 2 and 3, the opposite end of one of the levers 27 is pivotally connected to the lower end of arm 39, while the upper end of arm 39 is pivotally connected to handle 40 intermediate its ends. One end of handle 40 is pivotally connected to the upper end of a post 41 that extends upwardly from base 7, while the opposite end of handle 40 carries a hand grip 42. With this construction, upward pivotal movement of handle 40 will pivot wheels 35 downwardly relative to base 7 of frame 6, so that both the castor wheels 34 and the wheels 35 will be at a level beneath base 7, as seen in FIG. 2, thus supporting the lift 1 for movement on floor 43. Wheels 35 can be maintained in the lower position by engagement of the handle 40 with an upper bracket or keeper 44 which is mounted on an L-shaped bracket 45 that is attached to frame 6.

Pivoting the handle 40 downwardly will cause wheels 35 to move upwardly relative to frame 6, so that the base 7 of frame 6 will then be supported on the floor 43 or foundation, as shown in FIG. 3, and the wheels 34 and 35 will be out of contact with the floor so that the frame will be virtually immovable.

Figure 4:
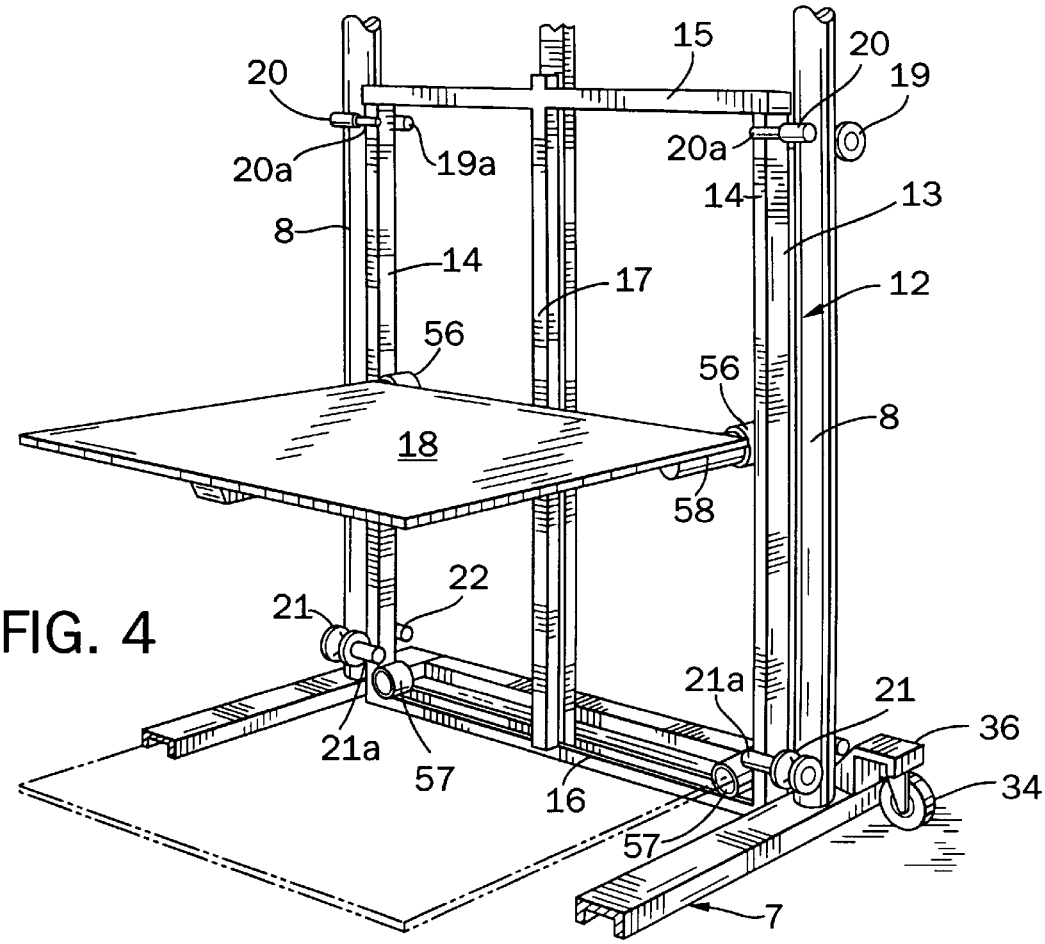
FIG. 4 is a fragmentary enlarged perspective view showing the mounting of the carriage to the frame.
Figure 6:
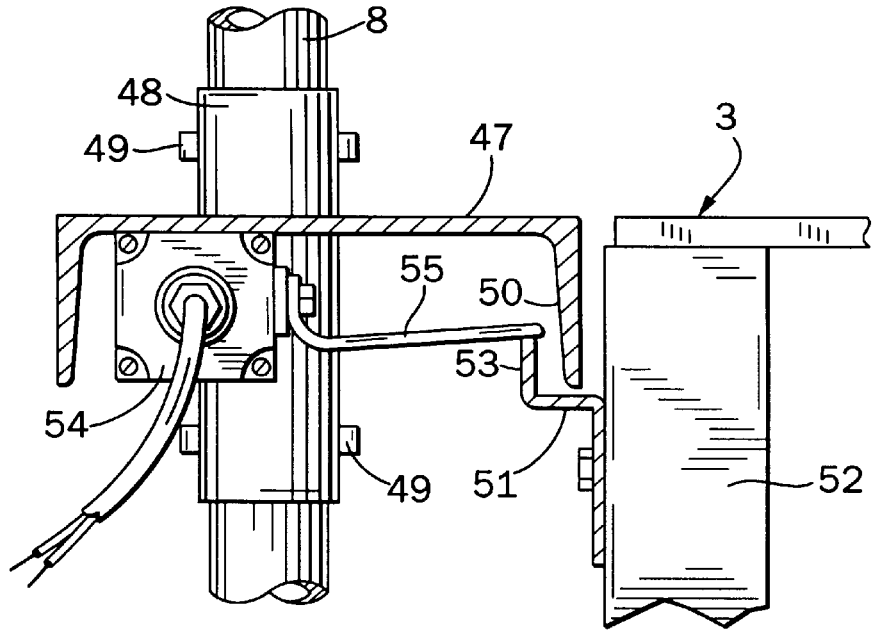
FIG. 6 is a view similar to FIG. 4 showing the locking mechanism in the locked position.

As a feature of the invention, a provision is made to lock frame 6 to the building when wheels 35 are in the upper or non-supporting position. In this regard, a channel-shaped lock bar 47 is adjustably connected to a pair of columns 8 of frame 6 as best shown in FIG. 4. Cylindrical sleeves 48 are mounted for sliding movement on the columns 8 and lock bar 47 extends between sleeves 48. Pins 49 can be inserted through suitable holes in sleeves 48 and through the columns 8 to maintain the sleeves and the lock bar 47 in the desired vertical position. When lock bar 47 is in the locked condition, as seen in FIG. 6, the upper flat surface of the lock bar is substantially flush with the upper surface of mezzanine 3, thus forming a threshold to facilitate movement of hand trucks to and from the carriage platform 18.

Figure 5:
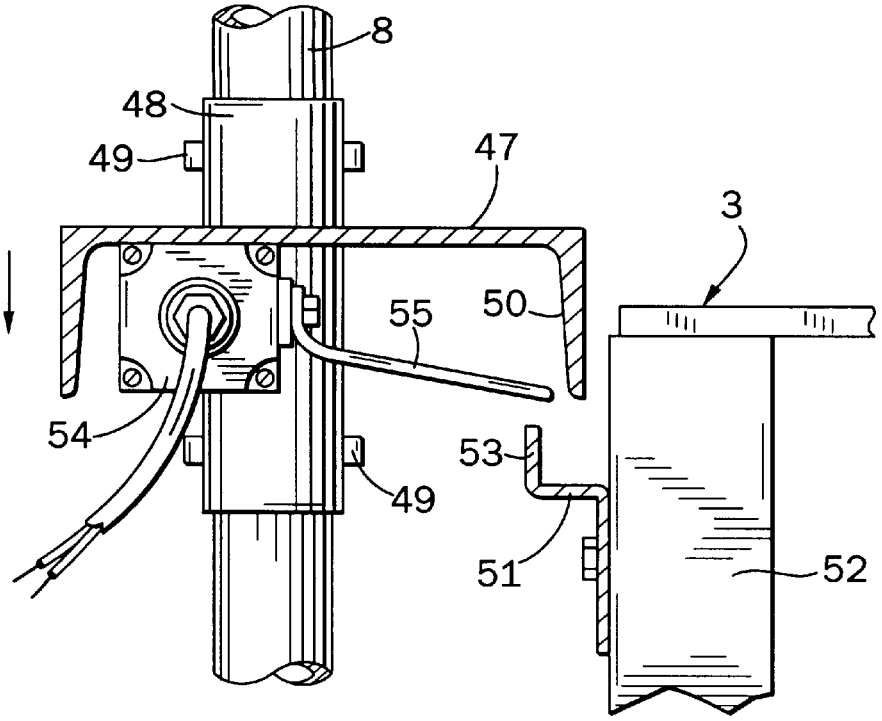
FIG. 5 is an enlarged fragmentary vertical section showing the locking mechanism for locking the frame to the mezzanine of the building with the locking mechanism in the unlocked position.

As shown in FIG. 5, lock bar 47 includes a downwardly extending flange 50 which is adapted to engage a bracket 51 mounted or secured to horizontal beam 52 of mezzanine 3 when frame 6 is lowered through upward movement of wheels 35. Engagement of flange 50 with lip 53 on bracket 51 will prevent frame 6 from accidentally moving away from mezzanine 3 during a loading operation.

The invention also includes a safety feature which prevents the hydraulic drive mechanism from operating if the lock bar 47 is not in the locked condition. In this regard, a switch 54 is mounted on the underside of lock bar 47 and is connected in electrical circuit with pump 27 of the hydraulic system. Switch 54 includes an actuating wand 55 which extends outwardly from the switch. When frame 6 and lock bar 47 move downwardly through upward movement of the wheels 35, wand 55 will engage the lip 53 of bracket 51, as shown in FIG. 6, thus actuating switch 54 to close the electrical circuit to pump 27 to enable the pump to supply pressurized hydraulic fluid to cylinders 23 and 24. With this construction, cylinders 23 and 24 can only be operated if the lock bar 47 is in the locked condition.

The connection of lock bar 47 to frame 6 through the adjustable sleeves 48 enables the locking mechanism to accommodate variations in height of the mezzanine 3.

As a further feature of the invention, a provision is made to selectively connect the cantilevered platform 18 to carriage 12 at two selective heights. A pair of tubular members or pipes 56 are connected to side members 14 of carriage frame 13 at a location intermediate of the length of the side members. In practice, the tubular members 56 would be positioned approximately two feet above the lower end of the carriage frame 13. In addition, a second pair of tubular members or pipes 57 are mounted on the lower ends of the respective side members 14.

A tube 58 is connected to the underside of each side edge of platform 18 and each tube 58 is adapted to be telescopically connected to either the upper tubular members 56 or the lower tubular members 57. Suitable pins can be inserted in aligned holes in the tubular members 56 or 57 and in the inner telescope members 58 to lock the platform 18 to carriage frame 13.

If the cargo or load is to be transported by mechanical handling equipment, such as a hand truck, platform 58 can be located adjacent the lower end of the carriage frame 13 as shown in FIG. 1, so that the carriage is substantially flush with base 7 of frame 6. A suitable tread plate 60 can be positioned adjacent one of the side members of base 7 to enable the material handling equipment to ride up to the frame and deposit the load on the platform 18.

On the other hand, if a lighter weight manually carried load is intended to be moved between the lower level 2 and the upper level 3, platform 18 can be positioned in its upper position, as shown in FIG. 4, where the platform is several feet above the floor in a location where the load can be more readily placed manually on the platform.

The lift of the invention is lighter weight and less expensive than vertical conveyors, and being portable, can be readily moved manually between different locations in a building or warehouse.

The lift is automatically locked to the building when the wheels are in the upper, non-supporting position, which prevents the lift from accidentally being moved during a loading operation. As a further safety feature, the hydraulic drive cannot be operated unless the locking mechanism is in the locked position.

The invention also provides a choice of platform height for either mechanical or manual loading.

We claim:

1. A portable lift for moving cargo between a lower level and an upper level of a structure, comprising a frame, wheel means connected to a lower end of the frame for moving the frame on the lower level of said structure, a carriage mounted for vertical movement on the frame for travel between said lower level and said upper level, drive means operably connected to the carriage for moving said carriage on said frame, said wheel means being mounted on said frame for movement between a supporting position wherein said wheel means supports the frame for movement on said lower level and a non-supporting position, and releasable locking means for locking the frame to the structure at a location adjacent said upper level when said wheel means is in the non-supporting position to prevent accidental movement of said frame on said lower level, said locking means having a locked position and an unlocked position.

2. The lift of claim 1, and including means responsive to movement of the wheel means from said supporting position to said non-supporting position for moving said locking means from the unlocked position to the locked position.

3. The lift of claim 1, wherein said locking means includes a first locking element on said frame and a second locking element on said building, said first locking element being disposed above said second locking element when said wheel means is in the supporting position, movement of said wheel means to said non-supporting position causing the frame and said first locking element to descend and affect engagement of said first locking element with said second locking element.

4. The lift of claim 1, wherein said frame is generally rectangular in cross section and includes a pair of opposed sides, said wheel means comprises a first pair of wheels located along a first of said sides and a second pair of wheels located adjacent a second of said sides, and pivot means for pivotally connecting said second wheels to said frame for movement between said supporting position and said non-supporting position.

5. The lift of claim 4, and including a manually operable handle operably connected to said pivot means for moving the wheel means between the supporting position and the non-supporting position.

6. The lift of claim 5, and including means associated with said handle for maintaining said second wheels in said supporting position.

7. The lift of claim 1, wherein said drive means comprises a pair of hydraulic cylinder units connected between said carriage and said frame.

8. A portable lift for moving cargo between a lower level and an upper level of a structure, comprising a frame, wheel means connected to a lower end of the frame for moving the frame on a lower level of said structure, a carriage mounted for vertical movement on the frame for travel between said level and said upper level, drive means operably connected to the carriage for moving said carriage on said frame, said wheel means being mounted on said frame for movement between a supporting position wherein said wheel means supports the frame for movement on said lower level and a non-supporting position, and releasable locking means for locking the frame relative to the structure when said wheel means is in the non-supporting position to prevent accidental movement of said frame on said floor, said locking means having a locked position and an unlocked position, said locking means including a first locking element on said frame and a second locking element on said building, said first locking element being disposed above said second locking element when said wheel means is in the support position, movement of said wheel means to said non-supporting position causing the frame and said first locking element to descend and affect engagement of said first locking element with said second locking element.

9. The lift of claim 8, wherein said first locking element comprises a downwardly extending flange and said second locking element comprises an upwardly facing recess on a wall of said structure.

10. A portable lift for moving cargo between a lower level and an upper level of a structure, comprising a frame, wheel means connected to a lower end of the frame for moving the frame on the lower level of said structure, a carriage mounted for vertical movement on the frame for travel between said lower level and said upper level, drive means operably connected to the carriage for moving said carriage on said frame, said wheel means being mounted on said frame for movement between a supporting position wherein said wheel means supports the frame for movement on said lower level and a non-supporting position, releasable locking means for locking the frame relative to the structure when said wheel means is in the non-supporting position to prevent accidental movement of said frame on said lower level, said locking means having a locked position and an unlocked position, and means responsive to movement of the wheel means from said supporting position to said non-supporting position for moving said locking means from the unlocked position to the locked position.

11. The lift of claim 10, and including means operably connected to said drive means for preventing operation of said drive means when said locking means is in the unlocked position.

12. The lift of claim 11, wherein said means for preventing operation of said drive means comprises a switch connected in an electrical circuit with said drive means, said switch having an open condition and a closed condition, and actuating means responsive to the locking means moving to the locking position for moving said switch to the closed condition to thereby permit operation of said drive means.

13. A lift for conveying cargo between a lower level and an upper level of a structure, comprising a main frame, a carriage having a carriage frame mounted for movement on said main frame from the lower level to the upper level, said carriage also including a generally flat platform connected to said carriage frame and adapted to support cargo, first mounting means disposed adjacent a lower end of the carriage frame for mounting the platform at a first lower position in cantilevered relation from said carriage frame, and second mounting means disposed above said first mounting means for mounting said platform at a second higher position in cantilevered relation from said carriage frame, said first mounting means comprising a pair of first tubular members disposed in horizontally spaced relation adjacent a lower end of said conveyor frame, said first mounting means also including a pair of second tubular members disposed in horizontally spaced relation on a side of said platform and disposed to be telescopically received with respect to said first tubular members.

14. The lift of claim 13, and including locking means for locking the first and second tubular members in telescopic relation.

15. A portable lift for moving cargo between a lower level and an upper level of a structure, a frame, wheel means connected to a lower end of the frame for moving the frame on a floor of said structure, a carriage mounted for vertical movement on the frame for travel between said lower level and said upper level, drive means for moving the carriage on the frame, said wheel means being mounted on said frame for movement between a lower supporting position where said wheel means supports said frame for movement on said floor and an upper non-supporting position, actuating means for moving the wheel means between said supporting position and said non-supporting position, releasable locking means for locking the frame to said structure when said wheel means is in the non-supporting position to prevent accidental movement of said frame on said floor, said locking means having a locked position and an unlocked position, and means responsive to movement of the wheel means from the supporting position to the non-supporting position for moving said locking means from said unlocked position to said locked position.

16. The lift of claim 15, and including means for preventing operation of said drive means when said locking means is in the unlocked position.

17. The lift of claim 15, wherein said locking means includes a generally flat plate that is disposed generally flush with said upper level when said locking means is in the locked position and comprises a threshold between said upper level and a cargo supporting surface of said carriage.

18. A lift for conveying cargo between a lower level and an upper level of a structure, comprising a main frame, a carriage having a carriage frame mounted for movement on said main frame from the lower level to the upper level, said carriage also including a generally flat platform connected to said carriage frame and adapted to support cargo, a pair of first mounting members disposed in generally horizontal spaced relation adjacent a lower end of said carriage frame, a pair of second mounting members disposed in generally horizontally spaced relation on said carriage frame and located above said first mounting members, and a pair of third mounting members disposed in generally horizontally spaced relation adjacent a side of said platform and disposed to be selectively telescopically connected to either said first mounting members or said second mounting members, connection of said third mounting members with said first mounting members positioning said platform at the lower end of the carriage to receive cargo from material handling equipment and connection of said third mounting members with said second mounting members positioning said platform at a higher level in position to receive manually carried cargo.

19. The lift of claim 18, wherein said first mounting members, said second mounting members, and said third mounting members are tubular.

20. A lift for conveying cargo between a lower level and an upper level of a structure, comprising a main frame, a carriage having a carriage frame mounted for movement on said main frame from the lower level to the upper level, said carriage also including a generally flat platform connected to said carriage frame and adapted to support cargo, first mounting means connected to a side edge of said platform, second mounting means connected to the carriage frame, third mounting means connected to the carriage frame at a location above said second mounting means, said first mounting means being constructed and arranged to selectively engage said second mounting means to thereby position the platform in a cantilevered relation at a first lower position on said carriage frame and said first mounting means being constructed and arranged to selectively engage said third mounting means to thereby position the platform in a cantilevered relation at a second elevated position on said carriage frame.

* * * * *

UNITED STATES PATENT AND TRADEMARK OFFICE

CERTIFICATE OF CORRECTION

PATENT NO. : 5,941,347

DATED : August 24, 1999

INVENTOR(S) : Robert H. Pfleger et al

It is certified that error appears in the above-indentified patent and that said Letters Patent is hereby corrected as shown below:

In the Claims:

Col. 5, line 40, CLAIM 2, Cancel claim 2; Col. 5, line 44, CLAIM 3, Cancel claim 3; Col. 5, line 63, CLAIM 5, Before "wheel" insert --second--; Col. 6, line 20, CLAIM 8, Cancel "building" and substitute therefor --structure--; Col. 6, line 22, CLAIM 8, Cancel "support" and substitute therefor --supporting--; Col. 7, line 13, CLAIM 14, Cancel claim 14.

Signed and Sealed this

Fourteenth Day of March, 2000

*Attest:*

*Attesting Officer*

Q. TODD DICKINSON

*Commissioner of Patents and Trademarks*